US005408171A

United States Patent [19]

Eitzmann et al.

[11] Patent Number: 5,408,171

[45] Date of Patent: Apr. 18, 1995

[54] COMBINED SOLID-STATE AND MECHANICALLY-SWITCHED TRANSFORMER TAP-CHANGER

[75] Inventors: Murray A. Eitzmann, Ballston Lake; Ann T. Hill, Ballston Spa, both of N.Y.

[73] Assignee: Electric Power Research Institute, Inc., Palo Alto, Calif.

[21] Appl. No.: 265,491

[22] Filed: Jun. 23, 1994

Related U.S. Application Data

[63] Continuation of Ser. No. 964,334, Oct. 21, 1991, abandoned.

[51] Int. Cl.[6] ..... G05F 1/16

[52] U.S. Cl. ..... 323/258; 323/343

[58] Field of Search ..... 323/256, 257, 258, 342, 323/341, 340, 255

[56] References Cited

U.S. PATENT DOCUMENTS

| | | | |
|---|---|---|---|
| 3,579,092 | 5/1971 | Matzl | 323/43 |
| 3,729,673 | 4/1973 | Schneider | 323/258 |
| 3,743,921 | 7/1973 | Legg et al. | 323/258 |
| 3,944,913 | 3/1976 | Kugler | 323/258 |
| 4,102,298 | 7/1978 | Dietze et al. | 118/5 |
| 4,550,285 | 10/1985 | Kugler et al. | 323/343 |
| 4,571,499 | 2/1986 | Wein | 307/75 |
| 4,622,513 | 11/1986 | Stich | 323/343 |
| 4,829,229 | 5/1989 | Johannsson et al. | 323/209 |
| 4,860,145 | 8/1989 | Klingbiel | 361/18 |
| 5,006,784 | 4/1991 | Sonntagbauer | 323/343 |
| 5,166,597 | 11/1992 | Larsen et al. | 323/215 |

OTHER PUBLICATIONS

Feinberg, R. "Modern Power Transformer Practice", 1979, John Wiley & Sons.

EPRI Report EL-6943, "Flexible AC Transmission Systems (FACTS): Scoping Study", Sep. 1991.

EPRI Report EL-6079, "Study of Improved Load-Tap-Changing for Transformers and Regulators", Nov. 1988.

*Primary Examiner*—Steven L. Stephan
*Assistant Examiner*—Adolf Berhane
*Attorney, Agent, or Firm*—Flehr, Hohbach, Test, Albritton & Herbert

[57] ABSTRACT

Disclosed is an End-Turn Solid-State Switching (ETSS) transfomer tap which makes use of a high-speed solid-state switching network to select either the end-turn lead or one of a number of non-isolated taps on a transformer regulating winding, and connects the selected tap to, while disconnecting the previously selected tap from, a single output conductor carrying the transformer load current. ETSS effectively changes the reference to one of the possible taps interfaced to a solid-state switching network. The same transformer regulating winding connected to ETSS can also be connected in series with a slow-speed mechanically-switched tap-changer (LTC). ETSS selects one connection point on the regulating winding while LTC operation selects the second point. A difference voltage is produced, depending on the number of turns between the ETSS selected tap and the LTC selected tap. The sign of the difference in voltage depends on whether the ETSS selected tap is higher or lower than the LTC selected tap. The difference or tap selected voltage is in series with the transformer load current. In one embodiment, the high-speed solid-state switching network uses a "Staggered Progression of Solid-State Switches" (SPSS) to select one of a number of non-isolated taps on a transformer regulating winding and connect the selected tap in series with the load circuit. A switching network arranged according to the method SPSS reduces the necessary total switch power rating, and steady-state losses. ETSS can accomplish modulation of the tap-selected voltage about the nominal value established by the LTC.

3 Claims, 8 Drawing Sheets

COMBINED SOLID-STATE AND MECHANICALLY-SWITCHED TRANSFORMER TAP-CHANGER

This is a continuation, of application Ser. No. 07/964,334, filed Oct. 21, 1992 now abandoned.

BACKGROUND OF THE INVENTION

1. Field of Invention

This invention relates to tap changers used on transformers to select the output voltage from the transformer and, more particularly, relates to a combined solid-state and mechanically-switched transformer tap which provides fast, on-load switching and very fine voltage control.

2. Description of Related Art

Electric transformers utilize the principle of electromagnetic induction to step up or down a particular voltage level to a higher or lower voltage level. Electromagnetic induction induces a voltage on a conductor which is placed in a varying magnetic field. If the conductor is in the shape of a coil, the voltages induced on each turn of the coil are cumulative and therefore the voltage output is proportional to the strength of the magnetic field and the number of turns in the coil. Commercial transformers produce the varying magnetic field by applying an alternating current (AC) to an input or primary coil. By placing a magnetic core within both the primary or input coil and the output or secondary coil, the magnetic field is effectively coupled to the secondary or output coil and a voltage proportional to the number of turns in the secondary coil is produced. Since the amount of magnetic flux generated by the primary coil is proportional to the number of turns in that coil and the voltage produced by the output or secondary coil is proportional to the magnetic flux surrounding the secondary coil, the output voltage of the transformer is equal to the input voltage times the ratio of the number of turns in the input coil over the number of turns in the output coil provided losses are neglected. Thus by changing the ratio of input or primary turns to output or secondary turns, the ratio of input to output voltage can be changed thus controlling or regulating the output voltage of the transformer. Changing taps on a transformer regulating winding has long been used to control voltage magnitude, voltage phase angle, or both in electric power feeder circuits. Basically, the tap changer selects which turn in the secondary coil will be connected to the load circuit thereby changing the ratio of turns in the transformer and regulating the output voltage.

Changing taps can be accomplished with the transformer either on-load or off-load. Off-load changes are accomplished by using breakers to isolate the transformer and then manually switching the output connection from one tap to another. Such tap changes have been made under load with mechanically-switched devices or load tap changers (LTC). On-load tap changing requires that the regulating coil circuit be maintained while switching from one tap to the other. This is accomplished by a combination of selector switches and a diverter switch. One selector switch is positioned at the tap which is currently in service. The other selector switch is positioned and connected to the tap which will be put in service. The diverter switch has two main contacts each of which is connected to a selector switch. In addition, the diverter switch has two transition contacts, each of which is connected through a resistor or reactor to a selector switch. As the diverter switch is thrown from one main contact to the other, the transition contacts insert the resistors or reactors in the circuit until the switch makes contact with the second main contact. Thus, the regulating coil is maintained continuously in the circuit and circulating currents between the two taps are dissipated by the resistors or reactors. The time required for the complete tap change is on the order of 1 to 2 seconds. For damping electro-mechanical rotor oscillations in electric power grids and for compensating sudden load changes due to faults, high-speed tap-changing after one-cycle of power frequency is needed to stabilize power supply networks. In addition, the use of mechanical contacts in the diverter switch invariably leads to some arcing which in turn contaminates the insulating oil of the transformer.

Efforts to speed-up the operation of on-load tap changers and to eliminate arcing have included the use of solid-state switches such as thyristors to replace the diverter switch. U.S. Pat. No. 5,006,784 issued to Ernst Sonntagbauer on Apr. 9, 1991 describes such a system and is incorporated by reference herein. The use of solid-state switching can reduce the time required to accomplish a tap change to 120 to 200 microseconds. However, the system described in the Sonntagbauer patent still contains a number of significant drawbacks. Voltage or phase shifting regulation by tap changing is limited to changes between fixed tap positions which are determined during the design of the transformer. These tap positions generally provide for transformer output changes between 2% and 5% of the transformer nominal rating. Modulation between these steps is not possible. In addition, the thyristors used must be capable of withstanding full load current which increases initial cost and reduces the effective service life of the thyristors. Finally, on existing transformers, the mechanical diverter switch must be replaced with a thyristor network at considerable expense and labor.

One approach to overcoming these limitations is disclosed in "Flexible ac Transmission Systems (FACTS): Scoping Study" EPRI Report EL-6943 published September 1991, and subject in U.S. patent application Ser. No. 07/742,859, commonly assigned to the assignee of the present application and incorporated by reference herein. In that patent application, the use of a variable susceptance device in parallel with the series winding of a phase shifter is used to modulate the phase shifting capability of the unit between that provided by the discrete tap positions. In addition, the use of a thyristor valve connected to one of the unused taps on the regulating coil is placed in parallel with the LTC to effectively vary the tap position by discrete taps.

However, difficulties still remain with this scheme. The tapped voltage change following operation of tile thyristor-augmented reversing switch is equal to the total voltage rating of the regulating winding. The voltage rating of each thyristor switch is also equal to the total voltage rating of the regulating winding. The step change when switching can be too large to damp network oscillations. Also, a mechanical bypass switch is required to eliminate the nominal power losses which are roughly proportional to switch voltage rating. The tapped voltage change of the no-load thyristor tap-changer in parallel with LTC is still limited to a single step. While the size of the step can be an integer number of taps determined by mechanical selection, tile change in step size is too slow in speed to be useful for modulation. Also, because of the parallel connection of LTC and thyristor switch there is a possibility of circulating current when the thyristor switch is closed at a large change in tapped voltage from that established by the LTC. Such a circulating current would need to be limited by impedance or interrupted by a circuit breaker.

SUMMARY OF THE INVENTION WITH OBJECTS

It is one object of the present invention to provide a tap changer which can operate and regulate output voltage very quickly to restore regulated voltage or phase shift after an upset.

It is another object of the present invention to provide a tap changer which has very fine resolution and therefore can control output voltage or phase shift from a transformer within a very narrow band.

It is another object of the present invention to provide a fast and accurate tap changer which can be easily added to existing, mechanical tap changer equipped transformers with a minimum of modifications to the existing equipment.

It is yet another object of tile present invention to provide a system for fast and accurate tap changing using solid-state circuitry components with significantly reduced ratings from those used in prior solid-state tap changing circuits.

These and other objects are accomplished with an End-Turn Solid-State Switching (ETSS) transformer tap which makes use of a high-speed solid-state switching network to select either the end-turn lead or one of a number of non-isolated taps on a transformer regulating winding, and connects the selected tap to, while disconnecting the previously selected tap from, a single output conductor carrying the transformer load current. Normally the tapped voltage is referenced from the end-turn of the winding. ETSS effectively changes the reference to one of the possible taps interfaced to a solid-state switching network. The same transformer regulating winding connected to ETSS can also be connected in series with a slow-speed mechanically-switched tap-changer (LTC). ETSS selects one connection point on the regulating winding while LTC operation selects the second point. A difference voltage is produced, depending on the number of turns between the ETSS selected tap and the LTC selected tap. The sign of the difference in voltage depends on whether the ETSS selected tap is higher or lower than the LTC selected tap. The difference or tap selected voltage is in series with the transformer load current. In one embodiment, the high-speed solid-state switching network uses a "Staggered Progression of Solid-State Switches" (SPSS) to select one of a number of non-isolated taps on a transformer regulating winding and connect the selected tap in series with the load circuit. A switching network arranged according to the method SPSS reduces the necessary total switch power rating, and steady-state losses.

ETSS can accomplish modulation of tile tap-selected voltage about the nominal value established by tile LTC. Using this invention can reduce costs and produce technical advantages compared to prior art devices. Particular advantage is obtained when retrofitting LTC regulating transformers with ETSS because: modification to existing equipment is minimized, the existing regulating winding capacity is used for both ETSS and LTC, and circulating currents are not possible.

DETAILED DESCRIPTION OF THE PREFERRED EMBODIMENTS

Figure 1:
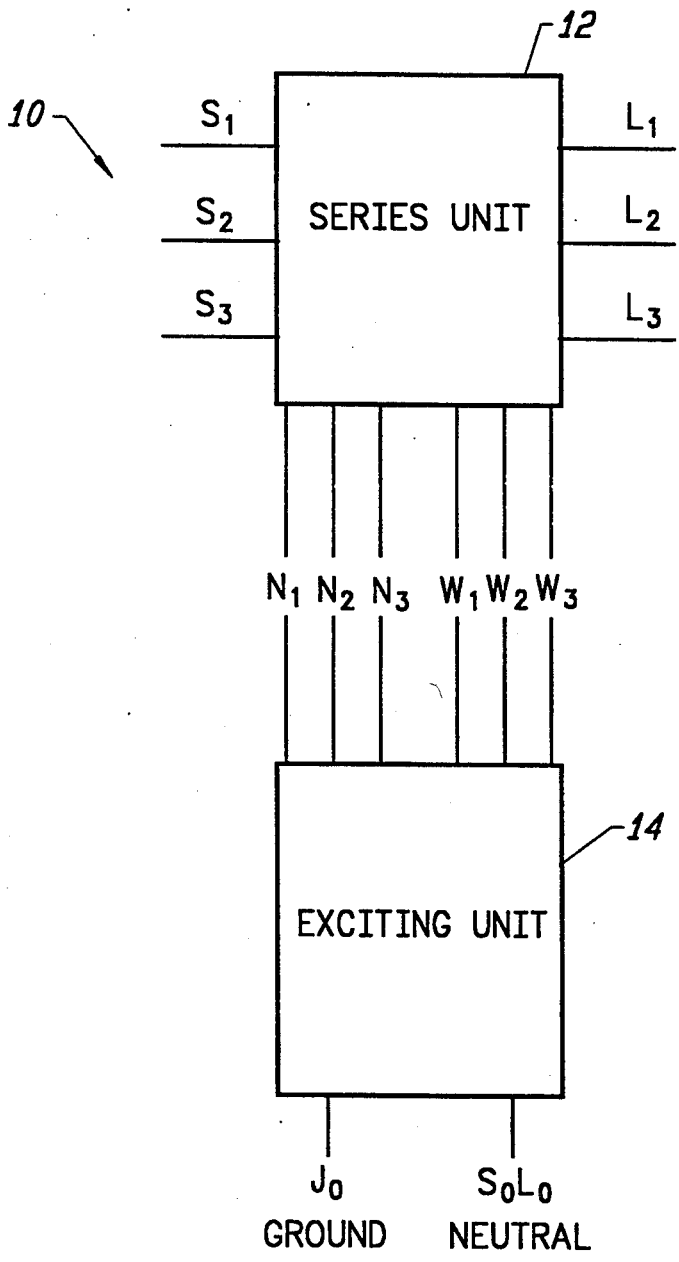
FIG. 1 is a schematic block diagram of a typical phase-angle regulating three phase transfomer.
Figure 2:
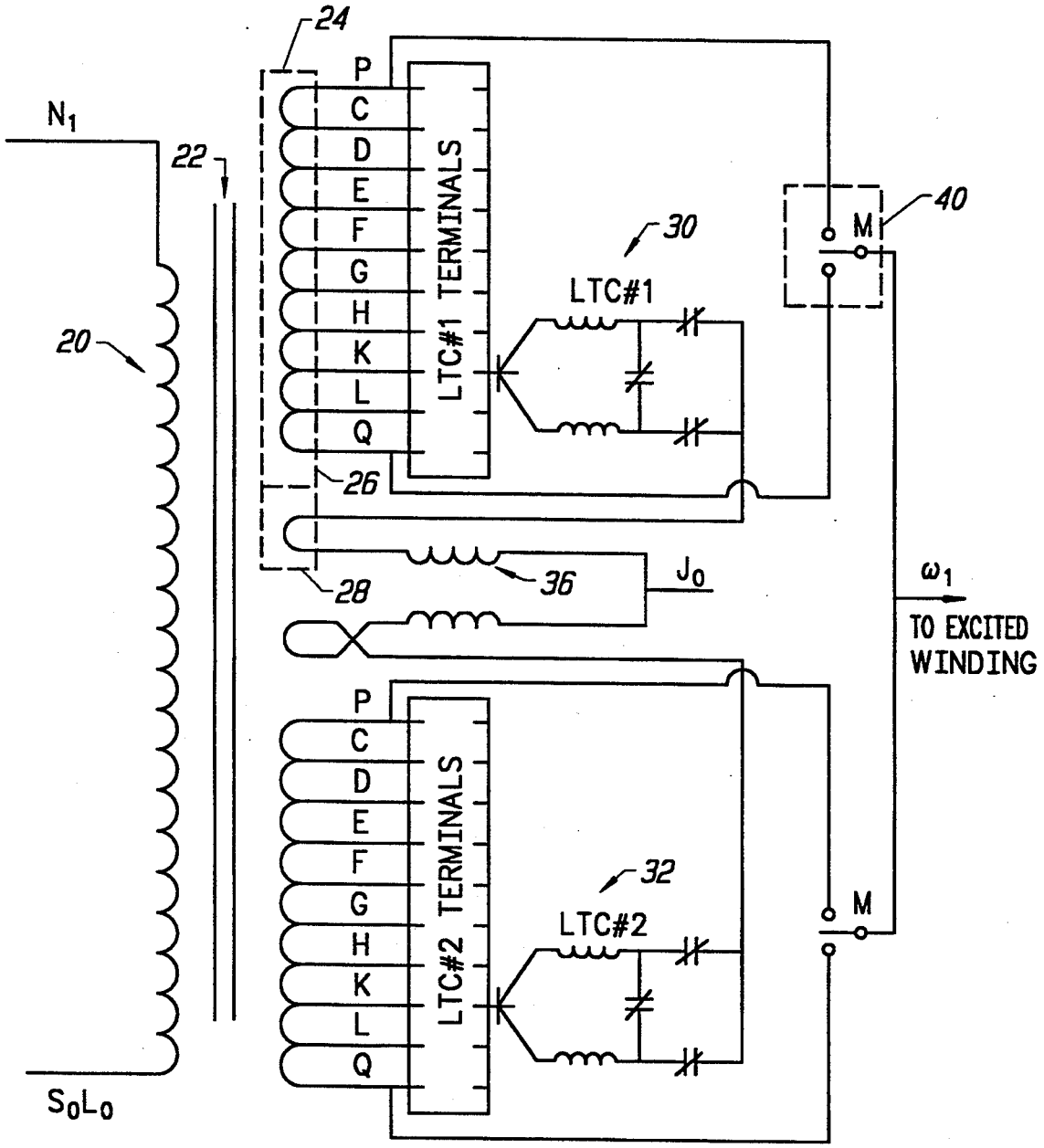
FIG. 2 is a circuit diagram for one phase of a transformer with a mechanical load tap changer and a mechanical reversing switch.

FIGS. 1 and 2 show diagrams of typical phase-angle regulating transformer equipment generally designated as 10 to which the invention of ETSS and SPSS can be applied. FIG. 1 shows a block diagram of a typical two-unit phase angle regulating transformer for three phase power. The transformer consists of the series unit 12 and the exciting unit 14. The external terminals including S1, S2 and S3 for the supply lines to the series unit 12 and L1, L2 and L3 for the output lines from the series unit 12. In addition, the internal series to exciting unit connections N1, N2, N3, W1, W2, and W3 are shown. Each transformer unit has internal coil and core assemblies (not shown).

Turning now to FIG. 2, the exciting unit 14 for one phase of the transformer is depicted. The exciting unit contains a primary winding 20 connected phase to neutral that creates a magnetic flux in a core 22 that induces a voltage in a tapped secondary winding 24 referred to as the regulating winding. It can be shown that a winding with N turns linked with the same magnetic flux which varies sinusoidally with the power frequency f has by electromagnetic induction an induced voltage v across the winding given by the following equation:

$$v=2\pi\phi Nf$$

The voltage across the coil is proportional to the number of turns selected. Tap-changing equipment changes the voltage by changing the number of turns connected in series with a load circuit.

FIG. 2 shows a circuit diagram of one phase of the exciting unit 14. Two LTCs 30 and 32 are connected in parallel to accommodate high circuit power. The parallel LTCs are connected through a mutual reactor 36 to promote current sharing. The common point of the mutual reactor 36 is connected solidly to ground through the $J_o$ terminal. There is one regulating winding 24 for each phase and LTC. Each regulating winding 24 consists of one or two sections, a tapped section 26 with non-isolated taps connected to an LTC terminal board and an optional fixed section 28 which can provide an offset in the regulating range. The direction or polarity of the load current in the tapped section 26 is reversed by a switch 40 that connects Q to M versus connecting P to M. P and Q are the end-turn connections to the tapped section 26 of the regulating winding 24. Load current is first bypassed, or the transformer is disconnected from the load, before the mechanical reversing switch 40 is operated. Such a switchover allows the same regulating winding 24 to be used in either polarity to give a bi-directional control range.

Figure 3:
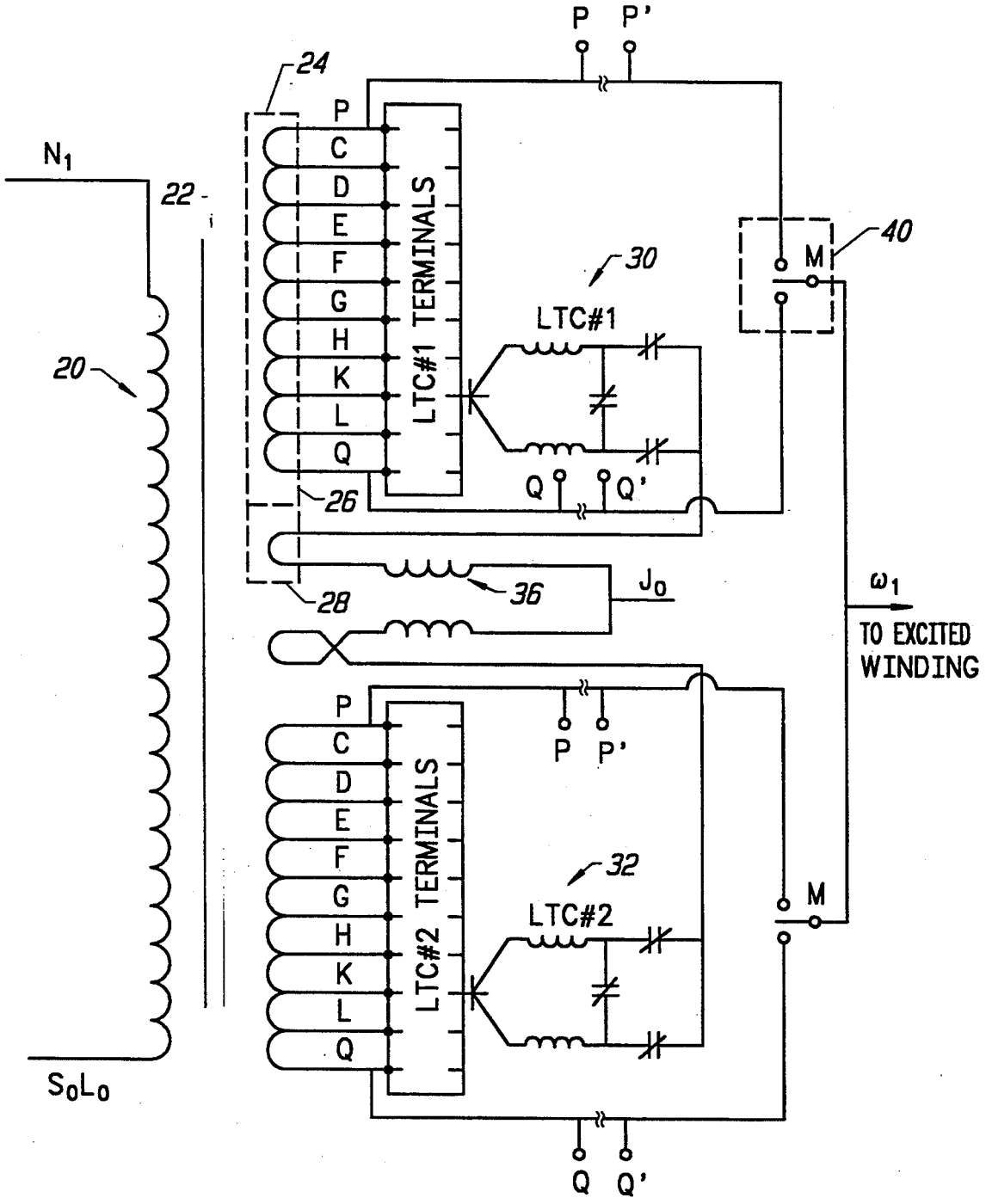
FIG. 3 is a circuit diagram for one phase of a transformer using the end-turn solid-state switching scheme of the present invention.

ETSS requires one switching network for each phase and for each LTC. FIG. 3 illustrates the additional connections and the break in the end-turn connection required for ETSS. When the reversing switch 40 is connecting P to M, the existing lead between P (end-turn) and the reversing switch is opened and these terminals (P and P') are made available for connection to the switching network. In addition non-isolated taps such as C,D,E, and F which are at an increasing number to turns away from the end-turn P are also made available to the solid-state switching network.

When the reversing switch 40 is connecting Q to M rather than P to M the existing lead between Q (end-turn) and the reversing switch is opened and these terminals (Q and Q') are made available for connection to the switching network in place of the connections to terminals P and P'. In addition non-isolated taps such as L,K,H, and G which are at an increasing number of turns away from the end-turn Q respectively are also made available to the solid-state switching network in place of the connections to C,D,E, and F respectively. To provide high-speed tap-changing, about the nominal point established by the LTC 30, 32 in either position of the reversing switch 40, a second mechanical switch, under oil, and operated at no load can be used to effect the switchover whenever the reversing switch is operated. With such a scheme, one solid-state switching network and one set of transfomer bushings (in this case 6) can be connected to either P,P',C,D,E, and F or to Q,Q',L,K,H,G to give a bi-directional control range.

It can be shown that with the reversing switch 40 connecting P' to M that a solid-state switching network that alternates connections between P to P' and C to P' effects a 2-step control. Either 0 or a negative change equal to the number of turns between P and C is selected. Similarly a solid-state switching network connecting other available taps to P' effects a known change of -k*n turns, where k is an increasing number of taps away from the end-turn and n is the number of turns for each tap. The nominal number of regulating winding turns in series with the load circuit is selected by the LTC. It is also possible to effect a positive change in the number of turns selected by connecting in steady-state one of the taps such as C to P', where upon, the LTC adjusts (provided the LTC 30, 32 has not already selected the maximum number of turns) to one higher tap to maintain the same nominal number of turns. This provides a possibility of making a positive change when the solid-state switching network connects P to P'. Examples of thyristors appropriate for performing the network function are General Electric type C795 thyristors. It is readily understood that although thyristors are described for accomplishing this function, other semiconductor devices such as silicon controlled rectifiers and triacs with the proper ratings could also be used.

Figure 4:
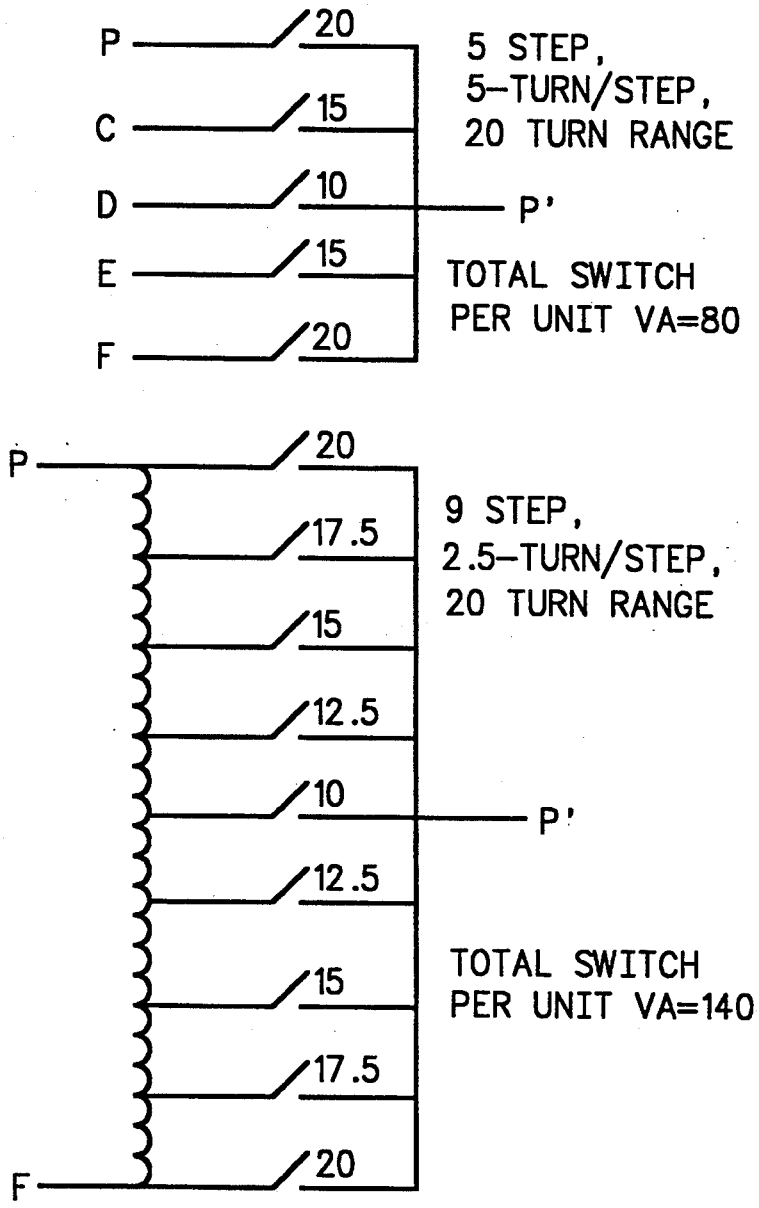
FIG. 4 is a schematic diagram of the typical switching arrangement used for tap changers.

First consider the use of parallel switches on a single bus, single switch arrangement where the output bus is connected by a single switch at a time to a non-isolated tap. FIG. 4 shows the switch arrangement for obtaining one tap out of 5 available taps. Assume there are 5 turns between adjacent non-isolated taps. Such an arrangement provides a 5-step, 5-turn/step, 20-turn control by the method of ETSS.

Solid-state switch power ratings are determined by the product of average closed-circuit current with peak open-circuit voltage. The closed-circuit current is mainly a function of the transformer load current properly reflected by the turns-ratio of the series unit transformer and delta-wye connection. For parallel LTCs half the load current is carried by each LTC and solid-state switching network. The open-circuit voltage that the switch must block is proportional to the number of turns the switch is connected across. Assume 1 p.u. peak voltage corresponds to the voltage induced in one turn of the regulating winding and 1 p.u. average current corresponds to rated load current conditions. From this the total volt-ampere requirements of a given switch arrangement may be determined on a relative basis.

Referring again to FIG. 4, the per unit switch power ratings necessary for this arrangement are given above each switch. Circuit constraints require that one switch is always closed and only one switch at a time is closed. It can be seen that the number of turns across the switches at the ends of the winding are greater than those for the switches closer to the middle of the winding. For instance, when F switch is closed while the other switches are open, the E switch sees the 5 turns between E and F, the D switch sees the 10 turns between D and F, C switch sees the 15 turns between C and F, and the P switch sees the 20 turns between P and F. When P switch is closed while the other switches are open, the switches have the reverse turns loading. Thus in either case, the middle switches have less loading than the end switches. For a k-step,t-turn/step control the single-bus single-switch arrangement gives a total per unit switch power rating given by the following equation:

$$VA = t\left[\frac{k-1}{2} + 2\frac{\frac{k+1}{2}}{\sum_{i=1} i}\right], k > 1$$

For the 5-step, 5-turn/step, 20-turn range control the total switch VA is 10+2*15+2*17.5+2*20=80. This is quite high and the utilization of the switches is low. The situation becomes worse with increasing number of steps. A Typical LTC can use 9 to 17 steps in one direction. If a 20-turn autotransformer with 2.5-turn taps is placed ahead of the switching network, the existing 5 turn taps can be subdivided to give 2.5-turn taps. For a 9-step, 2.5-turn/step, 20-turn range control the total switch VA increases to 10+2*12.5+2*15+2*17.5+2*20=140 which is a severe increase of 75% to achieve 9-step control versus 5-step control over the same control range. The single-bus single-switch scheme is inferior to the method of SPSS for more than 3-step control.

When thyristors are used to make up the solid-state switches, individual thyristors with a 3 to 6 kV blocking capability are connected in series to increase the switch voltage rating. Large diameter high current thyristors with large surge current capability can often be used so that parallel thyristors are not usually necessary. An alternate embodiment with an arrangement of switches that reduces the total switch power rating and in particular the total voltage rating will result in a reduced number of thyristors and hence reduced cost.

Figure 5:
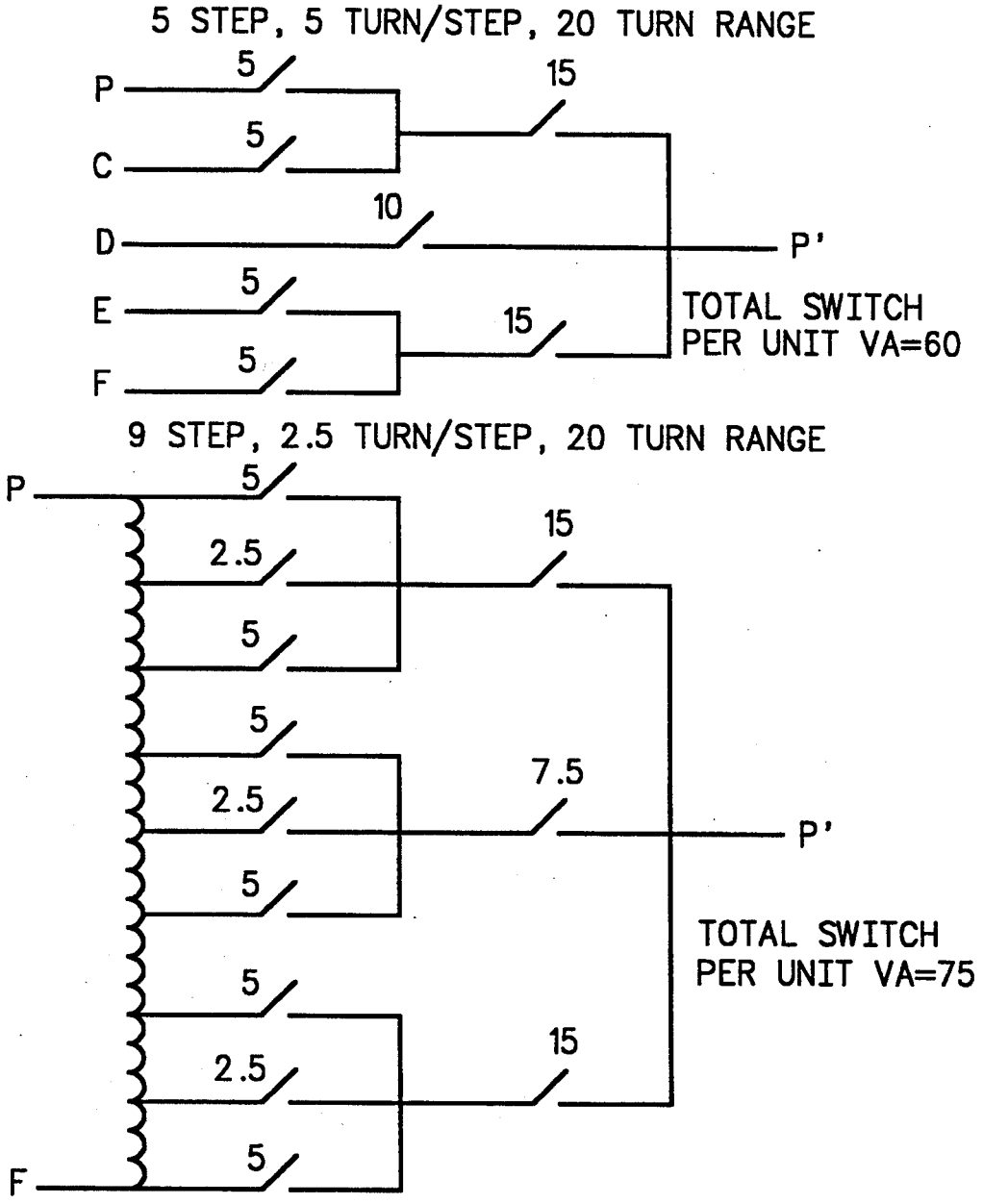
FIG. 5 is a schematic diagram of staggered progression switching scheme of the present invention.

An arrangement of switches in a tree structure with groups and levels in a hierarchy has been found to reduce the number of thyristors needed for a particular application. In particular the staggered pattern based on grouping switches in a "progression of three's" (SPSS) results in a large reduction in total switch power rating compared to the parallel switch arrangement. The reduction in switch power rating increases with the number of steps. SPSS is shown in FIG. 5 for the 5 and 9-step control, respectively. Basically the switches are arranged three per group and 1, 3, 9, . . . groups per level. The number of levels equals the number of times the number of steps is devisable by 3. For a 9-step control there are two complete levels completely filled in, 3 groups of 3 switches in the lower level and 1 group of 3 switches in the upper level. For a 5-step control there is a partial fill of the levels.

For a k-step, t-turn/step control the SPSS arrangement gives a total per unit switch power rating given by the following equation:

$$VA = \frac{5\ t\ k \log k}{3 \log 3},\ k \geqq 3$$

Referring again to FIG. 5, with SPSS the 5-step, 5-turn/step, 20-turn control has a total switch per unit power rating of 60 which is a 25% reduction compared to the unoptimized case. With SPSS the 9-step, 2.5 turn/step, 20-turn control has a total switch per unit power rating of 75 which is a 46% reduction compared to the unoptimized case. Although there are 2 more switches for 5-step control and 3 more switches for 9-step control with SPSS, the number of thyristors is reduced roughly in proportion to the reduction in total switch power rating. Utilization of the switches is improved over the parallel arrangement.

An added benefit with SPSS is that the highest level valve blocks 75% of the voltage from P to P'. Bypassing this level with a mechanical switch eliminates approximately 75% of the steady-state losses yet allows the low switch group to operate and effect a 3-step, 2.5-turn/-step, 5-turn control for small signal damping.

Protection and control requirements are not much different for SPSS compared to the parallel, single-switch single-bus arrangement. Either arrangement requires protective actions to limit and isolate failures.

With SPSS, at the upper level there is one group of 3 switches. Switch control is such that one and only one of the switches in the upper group is closed at any time. Preceding down the levels, one and only one of a group of 3 switches is closed and only if it's associated higher level switch is closed.

Falsely closing two or three switches in a group indicates a failure. Thyristor failure mode is closed. All lower level groups associated with the shorted upper level switch can be automatically closed creating a short-circuit condition which protects the solid-state switches from blocking too high a voltage. Protective relaying trips circuit breakers to isolate the partially shorted regulating transformer from the power system. For the case of a single switch failed closed, the remaining two switches in the group interrupt the short-circuit current at the next current zero. The control is theta locked at one tap until taken out of service and repaired.

Thyristors are closed with a low power gate signal when forward biased. Loss of gate signal prevents a switch from closing. Failure of the selected switch to conduct the load current causes the other switches to see an increased voltage indicating failure. Protective gating causes either a forced tap change or lock-up of the current tap until the control is taken out of service and repaired.

Figure 6A:
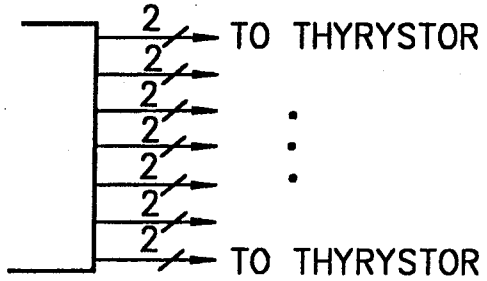
FIG. 6 is a schematic diagram of the regulator used to control the tap changer.
Figure 6:
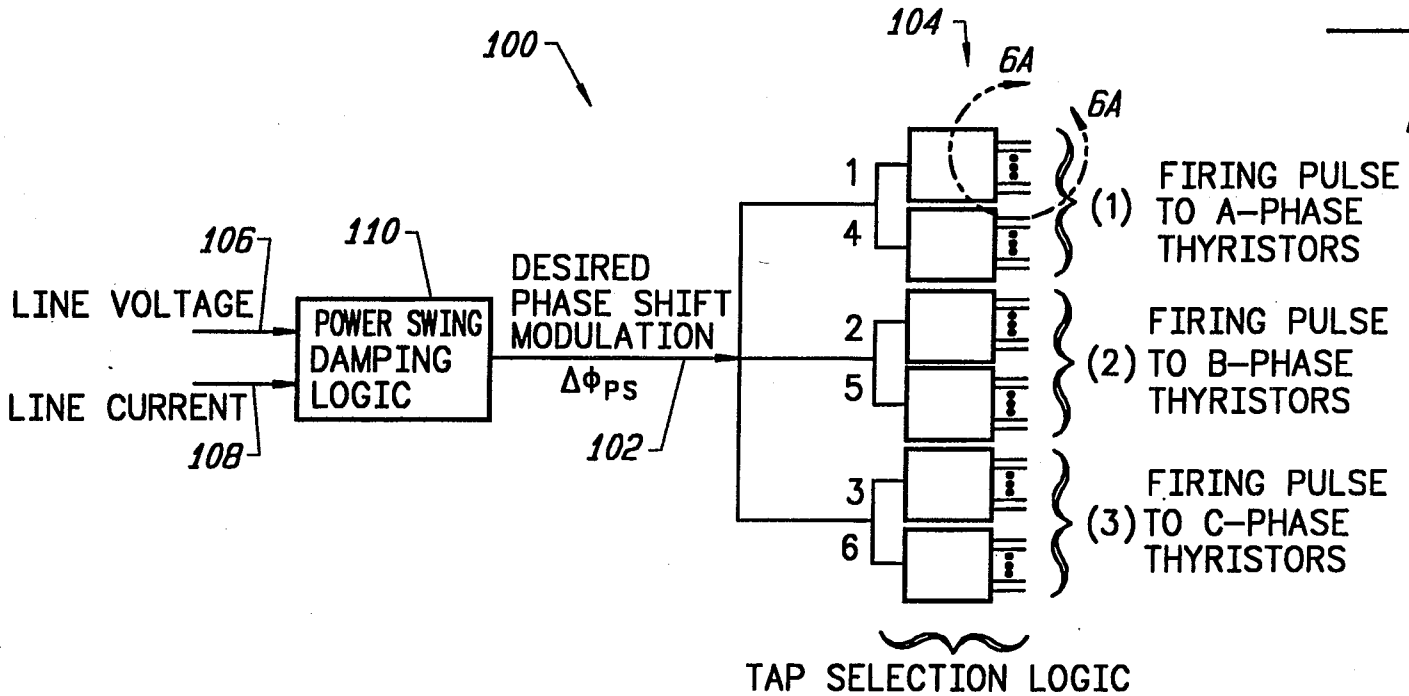
Figure 7:
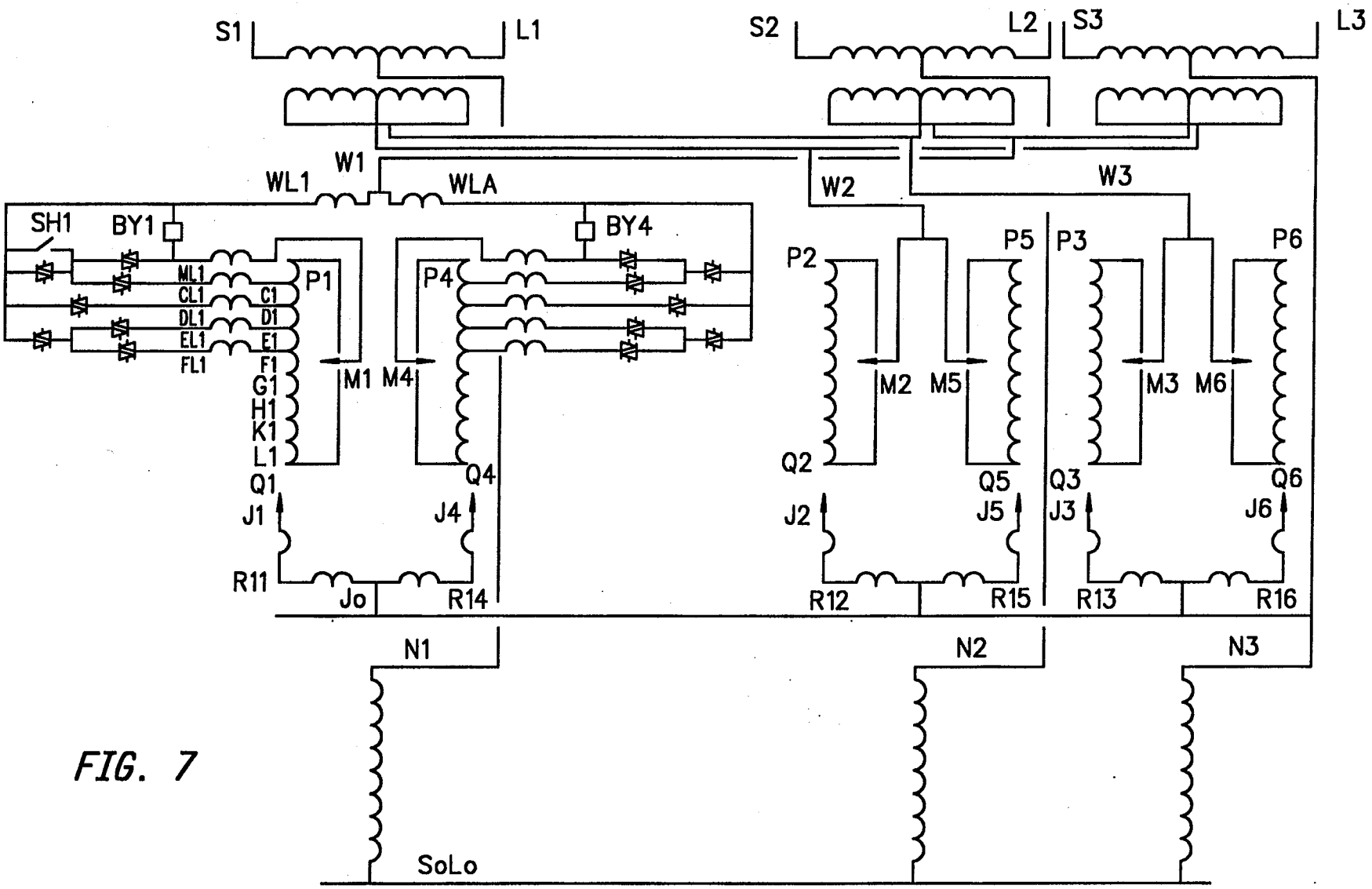
FIG. 7 is a schematic diagram of tile combined solid-state and mechanically switched transformer tap changer.
Figure 8:
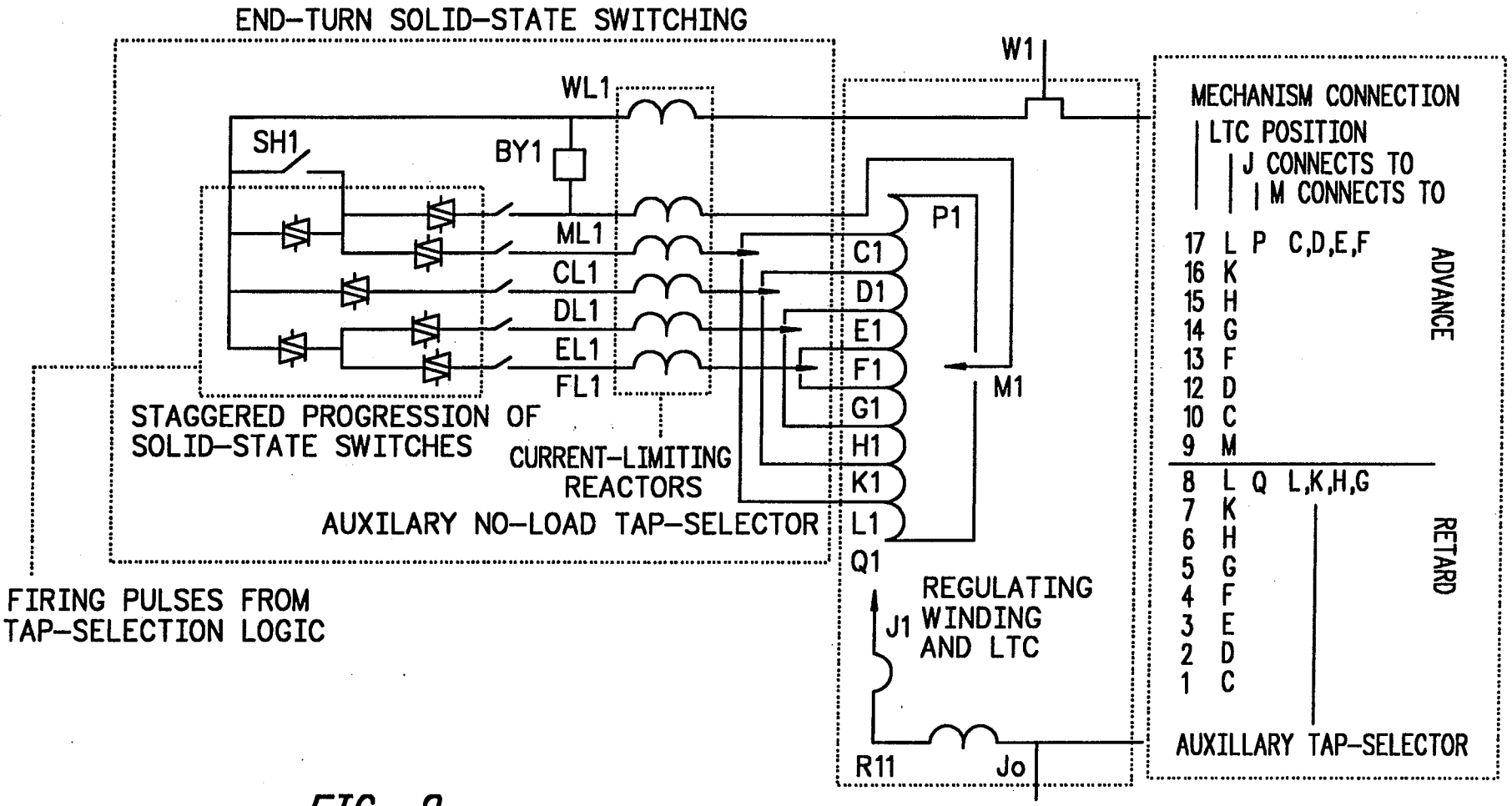
FIG. 8 is a one-line schematic for a regulating winding in one phase of the six regulating windings in tile combined solid-state and mechanically switched transformer tap changer.

Turning now to FIGS. 6, 7 & 8, application of the ETSS and SPSS combined mechanical and solid-state tap changer to a Thyristor Controlled Phase-shift Regulator (TCPR) is depicted. FIG. 6 provides an overview of the TCPR Controller 100. The TCPR Controller 100 sends a phase-angle modulation signal, $\Delta\phi_{ps}$, 102 into the Tap Selection Logic 104. The Tap Selection Logic 104 determines which thyristors to fire on the basis of the desired phase-shift modulation. The desired phase-shift modulation is determined by the TCPR Controller which detects a power system disturbance from locally measured line voltage 106 and line current 108. As one example, the Power Swing Damping Logic 110 may utilize frequency directly from the local line quantities or synthesize a frequency signal from some point remote from where measurements are made. A frequency transducer may directly measure the speed of a local generator to determine a phase-shift modulation signal on the basis of that machine speeding up or slowing down during a power system disturbance. A per unit change in speed is translated by the Power Swing Damping Logic 110 to send a desired phase-shift modulation signal, $\Delta\phi_{ps}$, 102 to the Tap Selection Logic 104 to fire the appropriate thyristors. A synthesized frequency signal would determine a relative speed of a remote generator or group of generators to be translated by the Power Swing Damping Logic 110 into a desired phase-shift modulation signal 102. The phase-angle modulation, $\Delta\phi_{ps}$, modifies the steady-state phase-shift tap selected by the mechanically-switched tap changer (LTC) as previously described.

Referring now to FIG. 7, an overview of the phase-shifter regulator winding is shown. The steady-state mechanically-switched tap changer (LTC) 30 or 32 is connected to terminals J1 and J4. The regulating windings are depicted as C1 through L1 and the end-turns by P1 and Q1. Current limiting reactors are identified as ML1, CL1, DL1, EL1, FL1 W1, WL1, and WL4 and are provided to protect the thyristors and regulating winding from excessive short circuit currents during fault conditions. Bypass breakers are identified as BY1 and BY4 and are provided to bypass the TCPR control leaving the LTC control unaffected. Turning now to FIG. 8, detail on the interconnections of one set of SSPS switches is shown. In operation, the switch SH1 is closed whenever the TCPR controller (shown in FIG. 6) settles down to where the $\Delta\phi_{ps}$ (desired phase shift modulation) is zero or a small value. Closing switch SH1 bypasses the upper level thyristor pair in SPSS. Bypassing the upper level thyristor pair eliminates the load losses of that thyristor pair. The lower level switching between ML1 and CL1 is unaffected. The dynamic range of the TCPR controller will be limited to a small range when SH1 is closed. A delay is necessary to open SH1 if the full dynamic range is required.

The table shown on the right of FIG. 8 shows the various connection and stages of regulation available with the TCPR. The first column are the tap positions available, 1–8 for retard and 9–17 for advance. In the advance positions, the reversing switch (part of the LTC) connects M to P. In the retard positions, M is connected to Q. An Auxiliary No-load Tap Selector switch is provided so that the TCPR can accommodate retard positions without needing additional thyristors, current-limiting reactors, or bushings. The Auxiliary No-load Tap Selector is controlled by the same logic that switches the LTC reversing switch from M to P to Q. Upon being switched, the Auxiliary No-load Tap Selector switches the taps available to the TCPR from C, D, E, and F to G, H, K, and L, thus providing the retard function.

The "End-Turn Solid-state Switching" (ETSS) disclosed herein is a significant modification and extension to the options for fast phase shifter control described in the prior art. ETSS allows high-speed discrete tap change control over a range of taps with the steady-state tap selected by the mechanically-switched tap changer (LTC). ETS S is effectively in series with the LTC thereby directly subtracting from or adding to the voltage established by the LTC. The subtracted or added tap voltage is ordered by automatic control of the solid-state switching network to accomplish modulation of tap voltage in discrete steps.

With ETSS multiple steps in tapped voltage can be selected by automatic control of a solid-state switching network to approximate a smooth sinusoidal modulation signal. ETSS is in series with the LTC and load current thus preventing the possibility of circulating current. ETSS can work in combination with an externally connected auto-transformer to provide a step size smaller than the LTC step size. Reduced cost is possible for new regulating equipment at a location where the tap range required for nominal control is larger than that required for high-speed control. Nominal control can be accomplished with an LTC which is less expensive than a high-speed tap-changer, and one transformer regulating winding can serve both purposes.

The "Staggered Progression of Switches" (SPSS) disclosed herein is a significant modification and extension to the options for fast phase shifter control available in the prior art. SPSS is an optimized arrangement of switches forming the solid-state switching network required for ETSS having the objective to minimize total switch power ratings and hence cost. SPSS is an optimized solid-state switching network for selecting one of a number of non-isolated tapped voltage sources for series connection in a load circuit. With ETSS multiple steps in tapped voltage can be selected by automatic control of the SPSS to approximate a smooth sinusoidal modulation signal.

Having thus described exemplary embodiments of the invention, it will be readily understood by those skilled in the art that particular components and arrangements of components used to implement the combined solid-state and mechanically-switched transformer tap-changer may be substituted for those described herein without departing from the spirit and scope of the invention claimed herein.

We claim:

1. In a transformer on-load tap changer of the type including an exciting winding and an excited winding with a regulating winding connected in series with said excited winding, said regulating winding having a plurality of taps, including a first subset of taps and a second subset of taps, connected to different turns of said regulating winding, the improvement comprising:

a plurality of solid-state switches directly connected to said first subset of taps;

a tap selection controller generating an electrical path, for a first voltage output, from a first tap of said first subset of taps, to a selected solid-state switch of said plurality of solid-state switches, to said excited winding; and a mechanical load tap changer switch creating an electrical path, for a second voltage output, from a second tap of said second subset of taps to said excited winding, said excited winding receiving said first voltage output and said second voltage output and yielding a difference voltage that is processed by said excited winding.

2. The apparatus of claim 1 wherein said plurality of solid state switches are configured in a staggered progression of solid state switches.

3. The apparatus of claim 2 wherein said staggered progression of solid-state switches comprise a network of switches arranged in a tree structure.

* * * * *